US007442426B2

(12) United States Patent
Shimodaira et al.

(10) Patent No.: US 7,442,426 B2
(45) **Date of Patent: *Oct. 28, 2008**

(54) PRESS FELT FOR PAPERMAKING

(75) Inventors: Masufumi Shimodaira, Tokyo (JP); Hiroyuki Oda, Tokyo (JP); Yasuhiko Kobayashi, Tokyo (JP); Akira Onikubo, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 847 days.

This patent is subject to a terminal disclaimer.

(21) Appl. No.: 10/783,107

(22) Filed: Feb. 20, 2004

(65) Prior Publication Data

US 2004/0166757 A1 Aug. 26, 2004

(30) Foreign Application Priority Data

Feb. 26, 2003 (JP) ..... 2003-048970

(51) Int. Cl.
*B32B 5/06* (2006.01)

(52) U.S. Cl. ..... 428/137; 442/183; 442/286; 162/358.2; 162/900

(58) Field of Classification Search ..... 442/183, 442/286; 162/358.2, 900, 35.2; 428/137
See application file for complete search history.

(56) References Cited

U.S. PATENT DOCUMENTS

| | | | | | |
|---|---|---|---|---|---|
| 4,446,187 | A * | 5/1984 | Eklund | ..... | 428/136 |
| 4,830,905 | A | 5/1989 | Gulya et al. | | |
| 5,071,697 | A * | 12/1991 | Gulya et al. | ..... | 442/56 |
| 5,372,876 | A | 12/1994 | Johnson et al. | | |
| 6,159,880 | A * | 12/2000 | Schiel | ..... | 442/270 |
| 2003/0051848 | A1 * | 3/2003 | Watanabe | ..... | 162/358.2 |

FOREIGN PATENT DOCUMENTS

| | | |
|---|---|---|
| JP | 3-8888 | 1/1991 |
| WO | WO 03029558 A1 * | 4/2003 |

* cited by examiner

*Primary Examiner*—Elizabeth M Cole
(74) *Attorney, Agent, or Firm*—Howson & Howson LLP

(57) ABSTRACT

A papermaking press felt comprises a base body, a batt layer, and an anti-rewetting layer comprising a non-oriented film, all intertwiningly integrated by needle punching. The anti-rewetting layer has openings with a three-dimensional structure, with an aperture on the paper web side larger than the aperture on the roll side. This press felt exhibits an excellent anti-rewetting effect while maintaining its water removing capability.

8 Claims, 11 Drawing Sheets

RE−WETTING TEST

SAMPLING
WATER CONTENT AT PRESS EXIT 1

RE−WETTING TEST

SAMPLING
WATER CONTENT AT PRESS EXIT II

FIG.12

| | anti-rewetting layer | physical properties of film | needle punching density | permeability | perforation condition | water content at press exit I (%) | water content at press exit II (%) | value of I − II (%) | evaluation of re-wetting |
|---|---|---|---|---|---|---|---|---|---|
| Example 1 | nylon-made non-oriented film | elongation at break: 500% thickness: 25 μ | 1000 times/cm$^2$ | 5 cc/cm$^2$/sec | funnel-shaped, no tear | 48.3 | 48.0 | 0.3 | excellent |
| Example 2 | nylon-made non-oriented film | elongation at break: 300% thickness: 25 μ | ditto | 6 cc/cm$^2$/sec | funnel-shaped, no tear | 48.2 | 48.0 | 0.2 | excellent |
| Comp. Example 1 | nylon-made biaxially oriented film | elongation at break: 125% thickness: 25 μ | ditto | 10 cc/cm$^2$/sec | funnel-shaped, small tear | 48.7 | 47.7 | 1.0 | poor |
| Comp. Example 2 | nylon-made uniaxially oriented film | elongation at break: 45% thickness: 25 μ | ditto | 15 cc/cm$^2$/sec | funnel-shaped, openings are connected because of tear | 50.0 | 48.0 | 2.0 | poor |

PRESS FELT FOR PAPERMAKING

FIELD OF THE INVENTION

This invention relates to papermaking felts used in the press part of a papermaking machine, and more particularly to improvement in the water-removing capability of a press felt.

BACKGROUND OF THE INVENTION

A press apparatus as shown in FIG. 13 is used conventionally to remove water from a wet paper web in a papermaking process. The press apparatus comprises a pair of press rolls P, and a pair of press felts 12 which support a wet paper web. The press apparatus squeezes water from a wet paper web W by applying pressure, by means of the rolls P, to the press felts 12 and, through the felts, to the wet paper web W. Water squeezed from the wet paper web W is absorbed by the press felts 12. Each of the press felts 12 comprises a base body for maintaining strength, and a batt layer on both sides of the base body. The base body and the batt layer are intertwiningly integrated by needle punching.

FIG. 14 is an enlarged view showing the nip of the press part of FIG. 13 in order to illustrate and explain the transfer of water squeezed from the wet paper web W. The details of the structure of the press felts 12 are not shown in this figure. When the press rolls P rotate in the direction of the arrows in FIG. 13, the press felts 12 and the wet paper web W are moved in the directions indicated by the arrows as they pass between the press rolls P. The press felts 12, and the wet paper web W are compressed in the press part, and water in the wet paper web W is squeezed and absorbed by the press felts 12. However, since pressure applied to the wet paper web W and the press felts 12 is abruptly released after the web and the felts move past the nip at the center of the press part, the volume of the press felts 12 suddenly as the felts and wet paper web move from the nip toward the exit of the press part. A negative pressure is generated in the press felts 12, and a capillary phenomenon occurs since the wet paper web W comprises fine fibers. Therefore, water absorbed by the press felts 12 is transferred back to the wet paper web. This is referred to as "re-wetting" and a well-recognized problem in a conventional press.

FIG. 15 shows a felt, described in U.S. Pat. No. 5,372,876, which is designed to prevent re-wetting. The felt 11, comprises a base body 31 and batt layers 21 on both sides of the base body 31. A hydrophobic film 41, made of a spun bond, is provided on the base body 31, and separates the press roll side layer from the wet paper web side layer. It is believed that, when this felt 11 is used, re-wetting is prevented, even when the pressure applied to the felt 11 is suddenly released, since the water absorbed in the press roll side layer is not easily transferred to the wet paper web side.

Unexamined Japanese Patent Publication No. 8888/1991 describes another approach to the re-wetting problem, in which a barrier layer is provided to prevent water, once absorbed, from being transferred to the wet paper web side.

U.S. Pat. No. 4,830,905 describes a press felt, in which a foam layer having closed cells is provided. It is believed that, when this felt is used, re-wetting is prevented since water is held in the cells.

Despite the above measures, a problem remains because, in the felts disclosed in U.S. Pat. No. 5,372,876 and Japanese Patent Publication No. 8888/1991, it is difficult to prevent the transfer of water since a hydrophobic film having a great number of apertures, and a porous film are used, respectively.

In the case of U.S. Pat. No. 4,830,905, there is the problem of discharging water from the cells of the foam layer.

SUMMARY OF THE INVENTION

The press felt for papermaking in accordance with the invention, has a wet paper web contacting surface and a roll contacting surface. The felt comprises a base body, a batt layer, and an anti-rewetting layer comprising a non-oriented film having openings. The openings have a three-dimensional structure, each opening having a wet paper web side end and a roll side end, each of said ends having an aperture, and the aperture of the wet paper web side end of each opening being larger than the aperture of the roll side end thereof.

Preferably, each opening is funnel shaped and has a tubular portion.

The non-oriented film is preferably composed of nylon, and has an elongation at break of at least 300%.

For improved permeability, the film may have flat openings in addition to the openings having a three-dimensional structure.

The three dimensional structure of the anti-rewetting layer exhibits a very effective anti-rewetting capability.

BRIEF DESCRIPTION OF THE DRAWINGS

FIG. 12 is a table showing the results of experiments on examples of press felts in accordance with the invention and comparative examples;

DETAILED DESCRIPTION OF THE PREFERRED EMBODIMENTS

Figure 1:
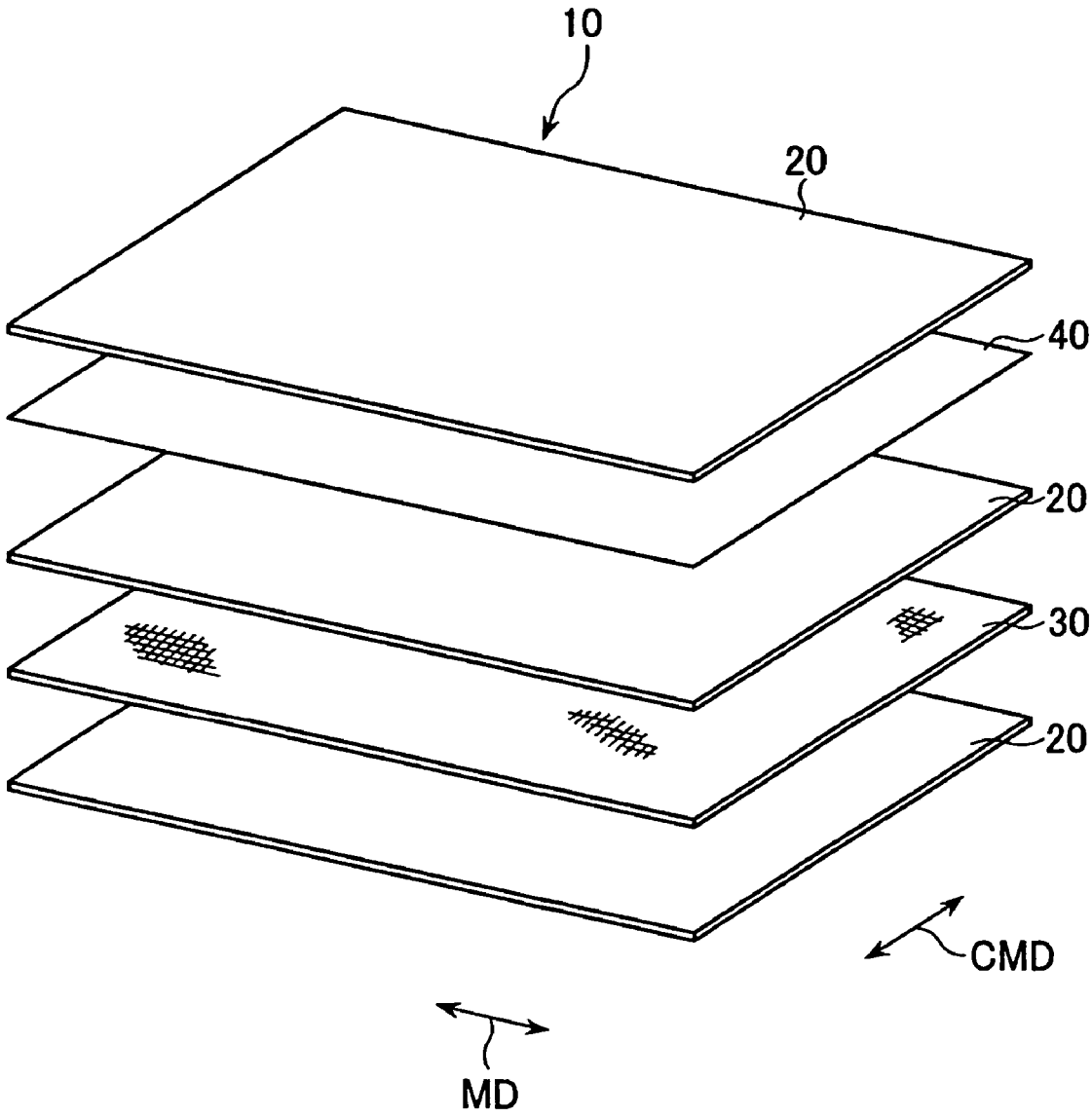
FIG. 1 is an exploded perspective view of a press felt according to the invention.
Figure 2:
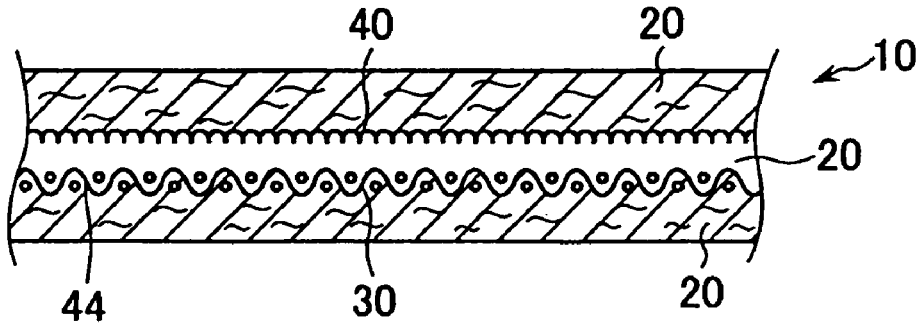
FIG. 2 is a cross-sectional view of a press felt according to the invention.

As shown in FIGS. 1 and 2, a press felt 10 in accordance with the invention comprises a base body 30, batt layers 20 made of staple fibers, and an anti-rewetting layer 40, all these layers being intertwiningly integrated by needle punching.

The base body 30 is provided to impart strength to the press felt, and a woven fabric or a band-shaped body which is not woven by a thread member, etc. is used as a material thereof.

Natural fibers such as wool, etc., or synthetic fibers such as nylon 6, and nylon 66, etc., which have superior resistance to abrasion, fatigue, elongation, fouling, etc., may be used for the base body 30 and the batt layer 20.

In the press felt 10 of FIG. 1, a batt layer 20 is provided between the anti-rewetting layer 40 and the base body 30. However, in an alternative embodiment, the anti-rewetting layer 40 and the base body 30 may be in direct contact with each other.

Figure 3:
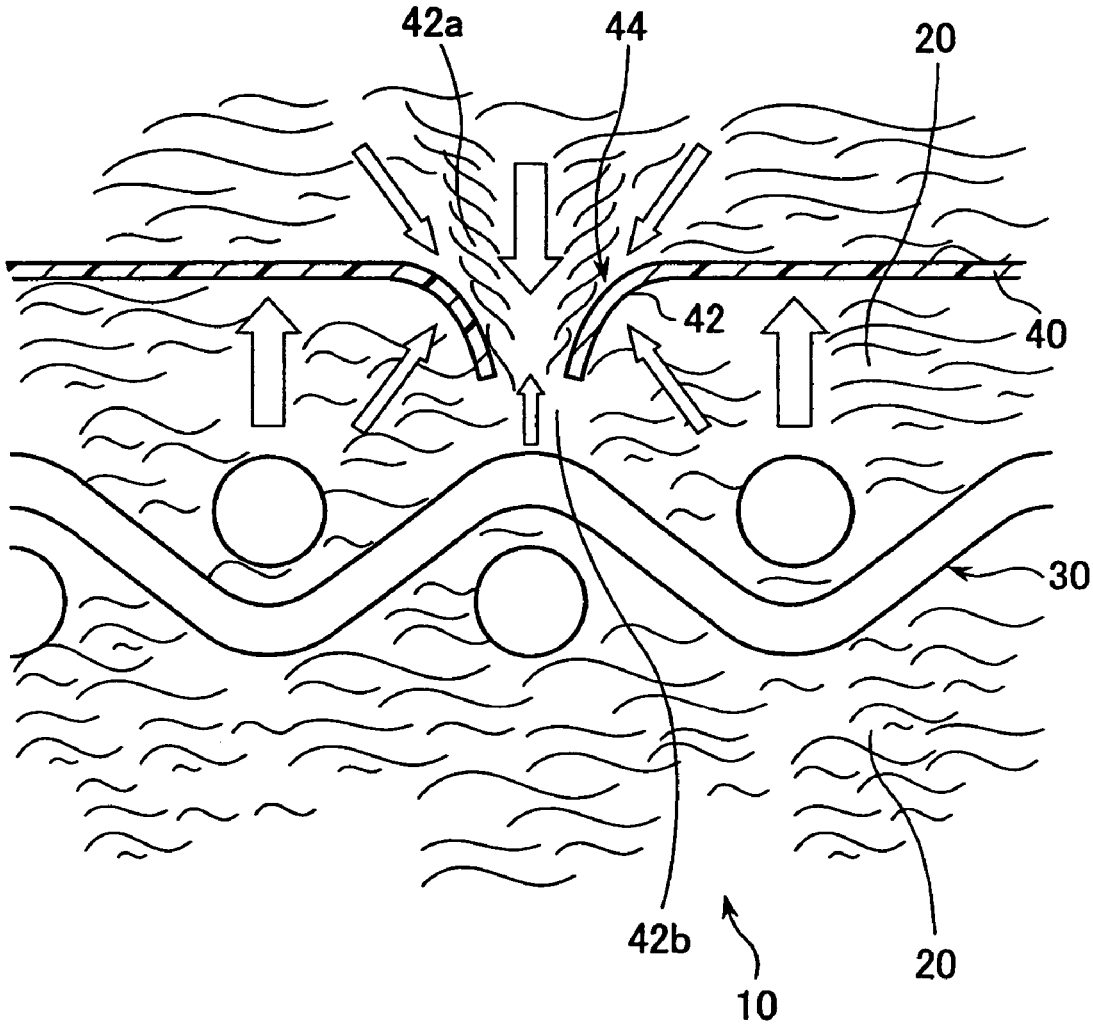
FIG. 3 is an enlarged cross-sectional view, showing details of an internal part of a press felt according to the invention.

As shown in FIG. 3, which is an enlarged partial view of FIG. 2, opening 44 is one of a number of similar openings in the anti-rewetting layer 40.

The anti-rewetting layer 40 is originally in the form of a thin film having no openings. This film is adhered, by needle punching, to the other components of the felt 10, in which staple fibers form the batt layers.

The anti-rewetting layer 40 is perforated in the needle punching process, and the openings formed by the needles have walls 42, which protrudes toward one side of the layer 40. In the case of FIG. 3, the wall 42 protrudes downward. Thus, the opening 44 has a three dimensional structure, comprising a wall 42, a wet paper web side end 42*a*, and the roll side end 42*b*. The wall 42 is tapered, so that the opening is funnel-shaped, with its wet paper web side end 42*a* being wider than its press roll side end 42*b*.

A non-oriented film is used for the anti-rewetting layer 40. The term "non-oriented," as used herein, is not intended to exclude even minor amounts of orientation, and thus includes orientation resulting from the film's own weight in the manufacturing process of the film, as known by those skilled in the art.

Furthermore, a low-water-absorbent film, such as polyethylene, polypropylene, polyvinylidene, polyester, or a water-absorbent film such as nylon or polyurethane, may be used as the film material.

In his case, it is preferable to select, as the film material, a material having a high melting point, such as nylon, polyurethane, polyester, etc., so that the film has sufficient heat resistance to withstand the heating operation in the felt manufacturing process may be obtained.

Nylon is frequently used as a material for the batt layer 20 and the base body 30. In this case, it is desirable also to use a nylon as the material of the anti-rewetting layer 40, to harmonize the elongation properties of the felt components when the felt, as a whole, becomes wet.

It was determined from experiments that, when the anti-rewetting layer 40 is made of nylon, its thickness is desirably in the range of 20 to 50:m, and its elongation at break is desirably 300% or more.

The elongation at break varies, depending on the material. The percentage elongation at break is preferably at least 300% for polypropylene, 200% for polyvinylidene, 100% for polyester, and 400% for polyurethane. A tear may occur upon elongation in the direction in which elongation at break is less than these lower limits.

The arrows in FIG. 3, shows the direction of movement of water. When nip pressure is applied by the press rolls, water from a wet paper web is transferred to the press felt 10. As pressure is applied in the nip, water moving from the wet web-contacting felt surface is transferred to the roll side of the felt after passing through openings 44 of the anti-rewetting layer 40. Water is transferred smoothly since the opening 44 is tapered.

After the felt moves out of the nip, and the nip pressure is released, re-wetting tends to occur. However, water transferred to the roll side of the anti-rewetting layer 40, is intercepted by the anti-rewetting layer 40, and the opening walls 42, and therefore it is difficult for water to transfer to the batt layer 20 of the wet paper web side.

Water cannot flow through the anti-rewetting layer 44 at locations where there is no opening 44. Moreover it is difficult for water to flow toward the wet web side of the felt through the openings 44 of the anti-rewetting layer 40, since the roll side ends 42*b* of the openings are narrower than the opening 42*a* on the wet paper web side.

In the manufacture of the felt, openings 44 are formed in the anti-rewetting layer 40, using needles, such as shown in IFG. 4, by the process illustrated in FIGS. 5(A)-5(E).

The needle 50 has a pointed tip 51, and a body, which is usually polygon-shaped in cross section. Barbs 52*a*, for catching and pushing staple fibers, are provided in the edges 52 of the needle body. In accordance with the invention, it is desirable to push as many staple fibers as possible into the anti-rewetting layer 40, and to make the wet paper web end 42*a* of the opening 42 large.

Figure 4:
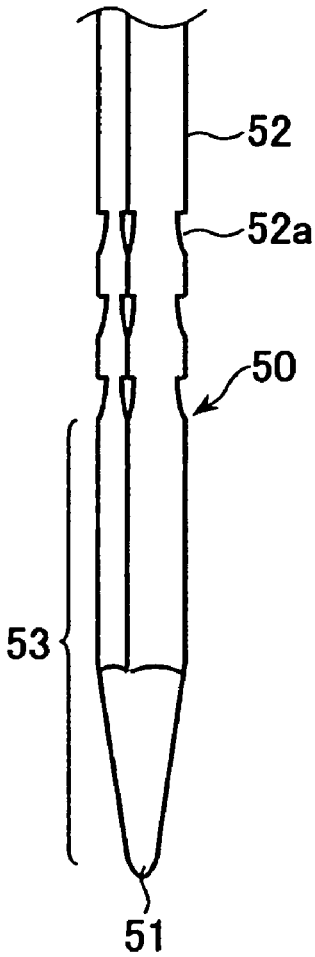
FIG. 4 is an enlarged elevational view of the point of a needle used in the production of a press felt according to the invention.

When barbs 52*a* are provided in two or more of the edges 52 of the needle, excellent results can be obtained. As shown in FIG. 4, needle 50, has a triangle-shaped cross section, and barbs 52*a* are provided in all the three edges 52.

The barbs are spaced from the point 51, and the length of the part of the needle between the point 51 and the barb 52*a* closest to the point 51, is referred to as the point length 53.

Figure 5A:
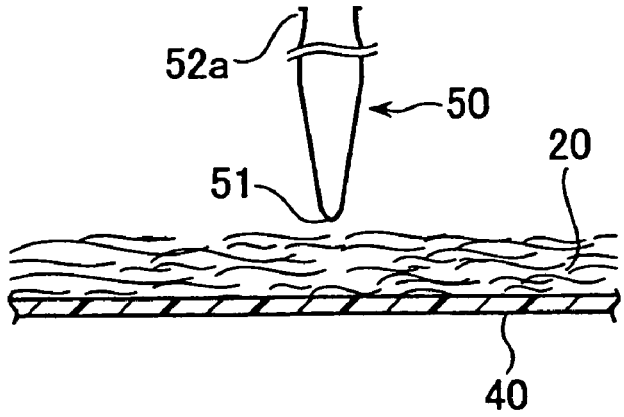
FIGS. 5(A)-5(E) are enlarged schematic views, illustrating the process of formation of an opening of an anti-rewetting layer of a press felt according to the invention.
Figure 5B:
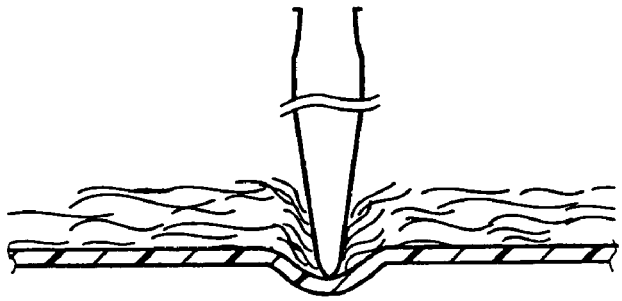

As shown in FIG. 5(A), staple fibers are provided on an unperforated, anti-rewetting film 40. A needle 50 is pushed into the top of the staple fibers. The point 51 of the needle 50 passes through the staple fibers and arrives at the anti-rewetting layer 40 as shown in FIG. 5(B). The needle 50 first pushes down the anti-rewetting layer 40 without immediately perforate it.

Figure 5C:
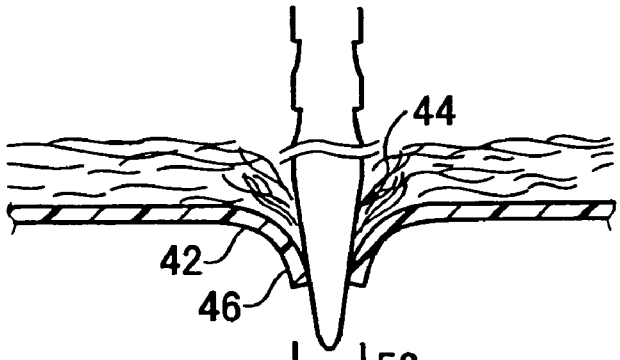

As the needle 50 continues, the anti-rewetting layer 40 is torn to form an aperture, as shown in FIG. 5(C), having a roll side opening 42*b*.

A part of the film which follows the progress of the point length 53 of the needle 50, is pushed down, forming a tubular section 46 which is of nearly uniform diameter.

Figure 5D:
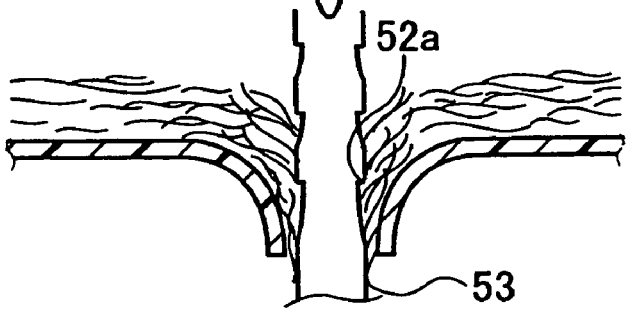

As shown in FIG. 5(D), as the needle continues to move, the barbs 52*a* hook the staple fibers and push them into opening 42. If barbs 52*a* are provided in plural edges 52 of each needle, more stable fibers are pushed into the openings 42 of the anti-rewetting layer 40.

Figure 5E:
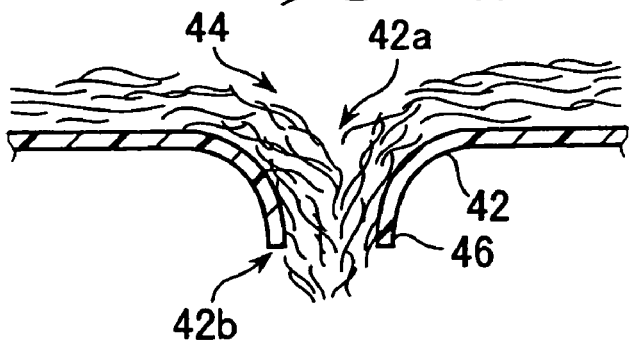

As the staple fibers are moved by the needles into the openings 42, the walls 42 of the openings are pushed down and formed into a tapered configuration so that the roll side ends 42*b* of the openings are smaller than the web side ends 42*a*, as seen in FIG. 5(E). After being pushed down to a predetermined position, the needle 50 withdrawn. The anti-rewetting layer 40 is then shifted laterally (horizontally in FIGS. 5(A)-5(E)) through a predetermined distance, and the needles 50 are again moved downward to punch the staple fibers into the anti-rewetting layer 40, repeating the action previously described.

By using a non-oriented film for the anti-rewetting layer 40, significant tearing of the anti-rewetting layer around the wet paper web side ends 42*a* of the openings and in the opening walls 42 is prevented. The openings 44 are thus prevented from becoming connected to one another, which can lead to long tears and ultimate destruction of the film.

In addition, when a non-oriented film is used, no tearing occurs in the openings even when high density needle punching is carried out. The film itself has elasticity, absorbing the shock at the time of needle punching. Therefore, the needle punching density may be increased, and improvement in adhesion of the batt layers to the film may be achieved as a result.

It has also been determined that, when a non-oriented film is used for the anti-rewetting layer, an excellent anti-rewetting structure may be achieved for two reasons. First, the distance between the wet paper web side ends of the openings and the roll side ends thereof is large because the film stretches as the needles push batt fibers into the openings. Second, the roll side ends of the openings shrink when the needles are withdrawn so that the diameters of the roll side ends of the openings become relatively small.

In contrast, when a uniaxially oriented film or a biaxially oriented film is used for an anti-rewetting layer, there is a problem, that the opening tear and the film becomes torn easily. A biaxially oriented film is superior to the uniaxially oriented film from this standpoint. However, when the conditions of needle punching becomes severe, the opening of the biaxially oriented film tends to tear. More particularly, it was determined from experiments on biaxially oriented films that, when the needle punching density exceeds 100 times/$cm^2$, openings tear along the direction of a higher stretch ratio of the film.

The needling operation described above may be conducted by vertical reciprocating movement of a needle board (not shown), on which a large number of like needles 50 is provided. Thus, the openings 44 are formed by punching staple fibers into the anti-rewetting layer 40, using needle 50 of a single kind and having a single thickness.

On the other hand, it is possible to provide needles of various kinds on a single needle board so that various properties of a papermaking felt, such as permeability, etc. may be achieved. For example, to obtain a desired permeability, it is possible to provide, on a single needle board, a first form of needle which is thicker than other needles, which has a sharp point and which has barbs only along one edge of its polygonal cross-section, and a second form of needle, having barbs in all of its edges, as shown in FIG. 4. In this case, openings having the three-dimensional structure shown in FIG. 3, and larger openings which are substantially planar, are both formed in the anti-rewetting layer. Thus, a felt which prevents re-wetting to some extent and yet exhibits excellent permeability, may be obtained.

The structure of the openings 44 can be controlled by selecting a non-oriented film having an appropriate elongation at break. The anti-rewetting layers 40, shown in FIGS. 6(A) and 6(B), both have openings 44, formed by a needle having barbs 52*a* in all of its edges 52, as shown in FIG. 4.

Figure 6A:
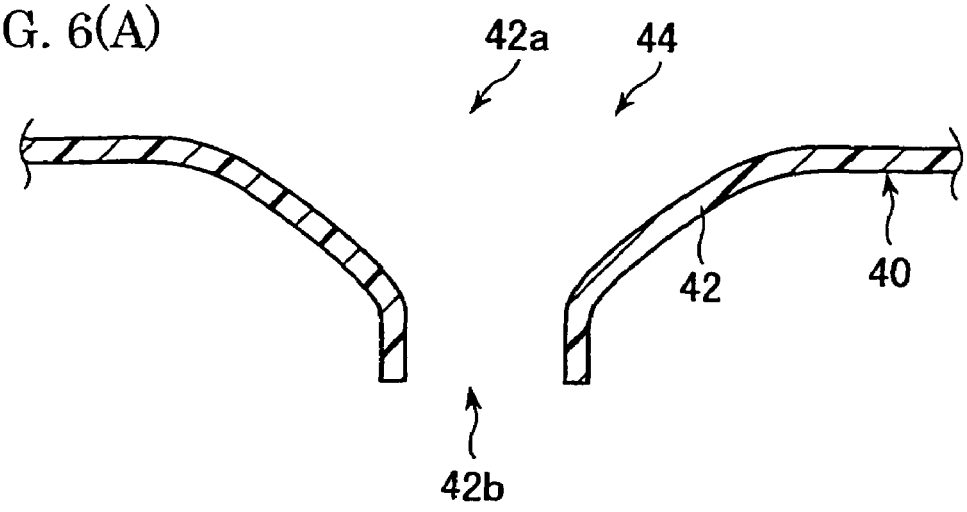
FIGS. 6(A) and 6(B) are enlarged cross-sectional views, showing different embodiments of an opening of an anti-rewetting layer of a press felt according to the invention.

In the case where the non-oriented film has a large elongation at break, as shown in FIG. 6(A). As described above, a tubular part 46 of the opening is formed by the needle adjacent the end 42*b* of the opening. The opening 44 comprises a tubular part 46 and a tapered part, and therefore has a funnel shape, which effectively resists flow of water through the opening from the roll side end 42*b* toward the web side end 42*a*.

Figure 6B:
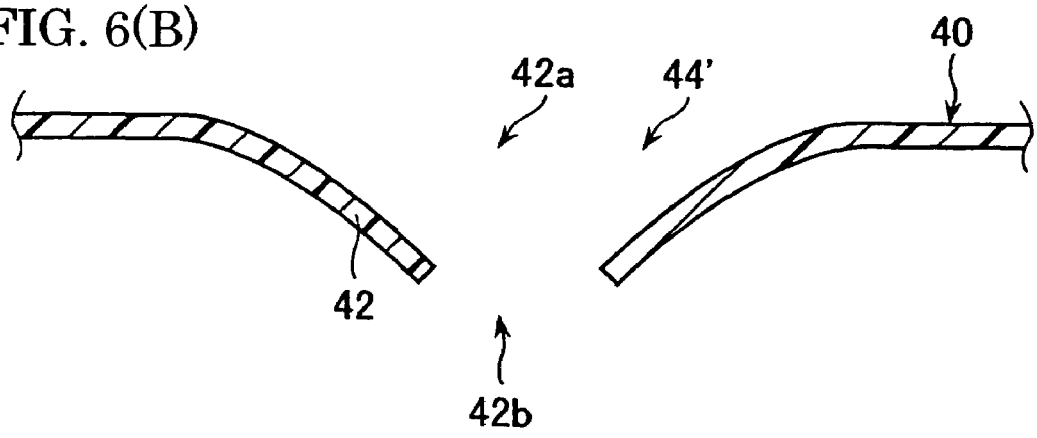

If the non-oriented film has a relatively small elongation at break the opening takes a tapered form of the kind shown in FIG. 6(B), and does not have a tubular part corresponding to part 46. in FIG. 6(A). In this case, although a tapered opening wall 42 may be formed in the anti-rewetting layer 40, by staple fibers drawn into the opening by barbs of a needle, the tubular sections are either not formed at all, or are very short in length. The opening structure shown in FIG. 6(B) is inferior to the opening structure of FIG. 6(A) insofar as its anti-rewetting effect is concerned. However, it may be utilized, for example, where improved productivity is important.

As will be apparent from the preceding description, when needle punching is carried out on a laminate comprising an anti-rewetting film disposed on a layer of staple fibers and a layer of staple fibers on top of the anti-rewetting film, the opening walls protrude downward and tend to become tapered, since they are formed while being supported by the lower layer of staple fibers. Instances of tearing of the anti-rewetting layer are low, since the shock imparted to the film in the needle punching process is eased by the lower layer of staple fibers. Consequently, the lower layer of staple fibers helps to produce openings 44 in which the wet web side ends 42*a* are larger than the roll side ends 42*b*.

In the manufacture of the press felt 10 according to the invention, after a layer of staple fibers is provided on a base body 30, the staple fibers and the base body are intertwiningly integrated by needle punching to form an integrated assembly comprising a base body 30 and a roll side batt layer 20. The integrated assembly is then reversed and the wet paper web side is formed.

Either of two general patterns in this process may be adopted. In one pattern, an anti-rewetting layer 40 and a layer of staple fiber are placed sequentially on the base body 30, and intertwiningly integrated with the base body by needle punching. In the other pattern, a layer of staple fibers is provided on an anti-rewetting layer 40. Then the layer of staple fibers and the anti-rewetting layer are integrated by needle punching, thus, forming a preliminary layer 60 (see FIG. 7). Then, the preliminary layer 60 is placed on the base body 30 and the two components, namely the preliminary layer 60, and the base body with the roll side batt layer, are intertwiningly integrated by needle punching.

In addition, a press felt having a batt layer 20 between the anti-rewetting layer and a base body 30, as shown in FIG. 1, may be produced by providing a layer of staple fiber on the base body 30, and thereafter, providing the anti-rewetting layer 40, or a preliminary layer 60, on the layer of staple fiber.

Figure 7:
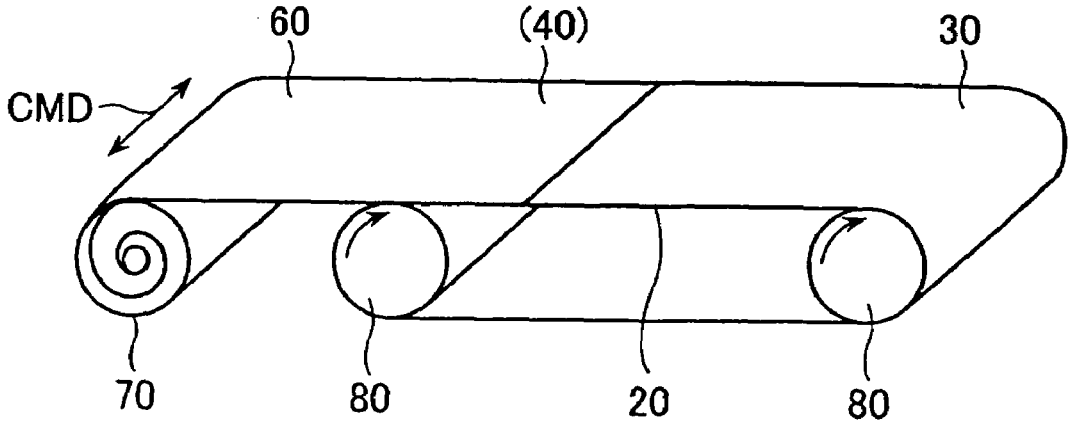
FIG. 7 is a perspective view illustrating a process of manufacture of a press felt according to the invention.
Figure 8:
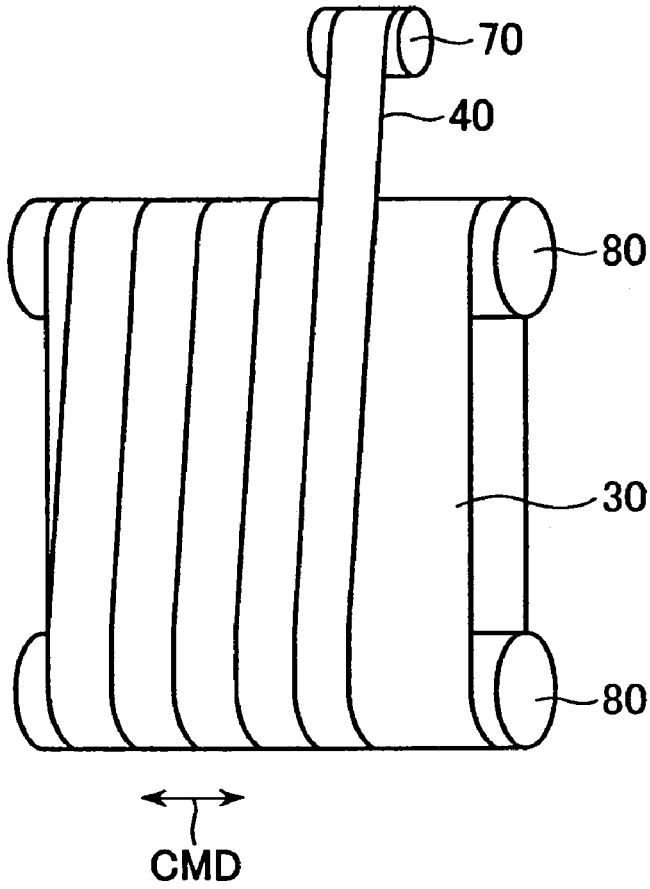
FIG. 8 is a perspective view illustrating another process of manufacture of a press felt according to the invention.
Figure 9:
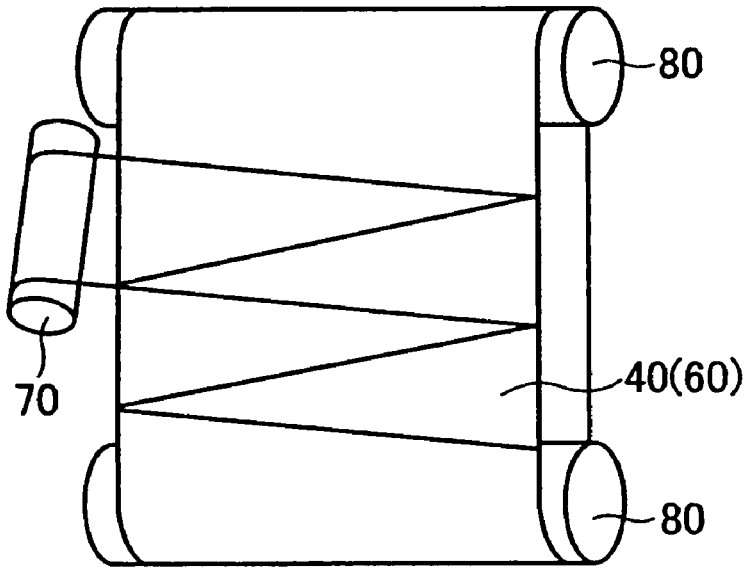
FIG. 9 is a perspective view illustrating yet another process of manufacture of a press felt according to the invention.

An anti-rewetting layer 40, or a preliminary layer 60, may be provided on a base fabric by any of the methods depicted in FIGS. 7-9. In each of these Figures, 70 represents a material roll on which an anti-rewetting layer 40, or a preliminary layer 60, is wound, and 80 represents stretch rolls spanned by a base body 30.

FIG. 7 shows a manufacturing method including the step of providing an anti-rewetting layer 40, or a preliminary layer 60, having approximately the same width, in the cross machine direction (CMD), as the base body 30. An end of the anti-rewetting layer 40, or preliminary layer 60, is first fixed to the base body 30. Then, as the base body 30 is moved by rotation of the stretch rolls 80, layer 40 or 60 is drawn from a material roll 70, so that the anti-rewetting layer 40 or preliminary layer 60 is provided on the base body 30. The anti-rewetting layer, or the preliminary layer, is cut approximately at the same position as the end thereof which was fixed to the base body 30, so that it has almost the same length as the base body. The cut end is then also fixed to the base body.

In the manufacturing methods depicted in FIGS. 8 and 9, the width of the anti-rewetting layer 40, or preliminary layer 60, is much less than the width of the width of the base body in the cross-machine direction.

As shown in FIG. 8, it is possible to wind the anti-rewetting layer 40, or a preliminary layer 60, in a flattened helix, with the layer 40 or 60 extending from the material roll along a direction different from, but nearly parallel to, the machine direction of the base body 30.

On the other hand, as shown in FIG. 9, it is also possible to place the anti-rewetting layer 40 or preliminary layer 60, along a direction different from, but nearly parallel to the cross machine direction of the base body 30. In this case, it is desirable to use only the anti-rewetting layer 40 without incorporating it in a preliminary layer 60. More specifically, the anti-rewetting layer 40 is unwound from the supply roll 70 and placed on the base body 30 from the one side to the other, at an appropriate angle relative to the cross machine direction. The layer 40 is unwound from the supply roll 70 and moved back and forth across the base body from one edge to the other, while moving the base body by rotating the stretch rolls 80. The direction of movement of the layer 40 is reversed as it reaches each side edge of the base body. This action is repeated until the base body is covered. In this case, the anti-rewetting layer 40 is held on the base body 30, by the weight of its turned parts at the edges of the base body 30. Needless to say, the anti-rewetting layer 40 should be laid on the base body at an angle such that the anti-rewetting layer covers the entire base body 30.

As described above, a film initially having no openings is preferably wound or laid onto the base body to form the anti-rewetting layer 40. However, it is also possible to improve permeability as needed in a needle felt for papermaking. In this case, a manufacturing method including a step of needling and perforating only the anti-rewetting layer 40, as appropriate, may be adopted.

It will be evident that various other modifications and changes may be made to the manufacturing process, and that the process described above is only an illustration.

EXAMPLES

Experiments were conducted to determine the effects of a papermaking press felt according to the invention.

To establish equivalent conditions for the examples and the comparative examples, the basic structure of all the felts was as follows:

Base body: plain weave of twisted yarn of nylon monofilament, with basis weight of 300 g/m$^2$ Batt layer: staple fiber of nylon 6 with total basis weight of 550 g/m$^2$ Needle punching density: 1000 times /cm$^2$ Needle: point 51 having R=0.075 mm at the tip; triangular cross section; and barbs 52*a* formed in every edge 52.

Example 1

Anti-rewetting layer 40: non-oriented film made of nylon
Elongation at break: 500%
Thickness: 25:
Shape of opening 44: funnel
Permeability: 5 cc/cm$^2$/sec

Example 2

Anti-rewetting layer 40: non-oriented film made of nylon
Elongation at break: 300%
Thickness: 25:
Shape of opening 44: funnel
Permeability: 6 cc/cm$^2$/ sec

Comparative Example 1

Anti-rewetting layer 40: biaxially oriented film of nylon
Elongation at break: 125%
Thickness: 25:
Shape of opening 44: funnel, but a tear in the direction of orientation of the film was found. The tear was not so large as to connect two openings 44.
Permeability: 10 cc/cm$^2$/sec

Comparative Example 2

Anti-rewetting layer 40: Uniaxially oriented film of nylon
Elongation at break: 45%
Thickness: 25:
Shape of opening 44: Funnel-shaped, but a large tear was found in the direction of orientation of the film. Two openings 44 were connected because of the tear.
Permeability: 15 cc/cm$^2$/sec After these press felts were prepared, experiments were conducted, using apparatuses shown in FIG. 10 and FIG. 11, each having a pair of press rolls P, a top side felt 110, a bottom side felt 10, a suction tube SC, and a shower nozzle SN.

The examples and the comparative examples were used as the bottom side felt 10 in both apparatuses. The press felt of Comparative Example 1 was used for the top side felt 110.

Figure 10:
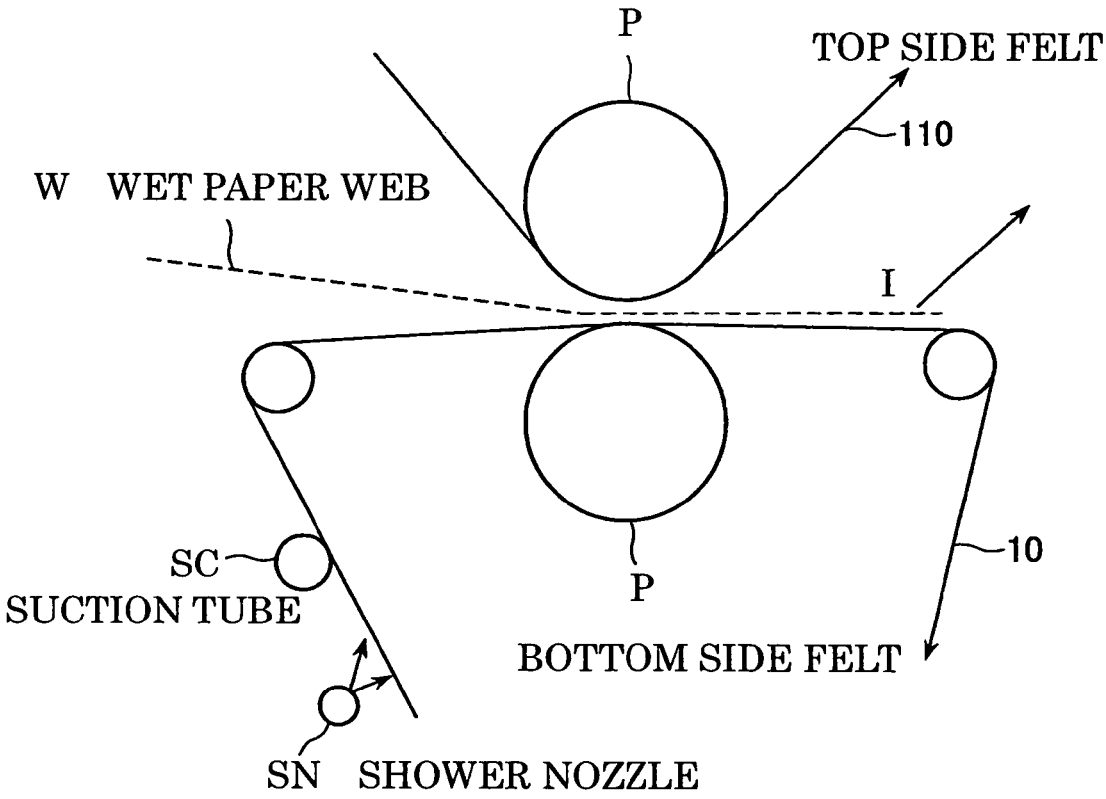
FIG. 10 is an schematic view of an apparatus for determining the effects of a press felt according to the invention.
Figure 11:
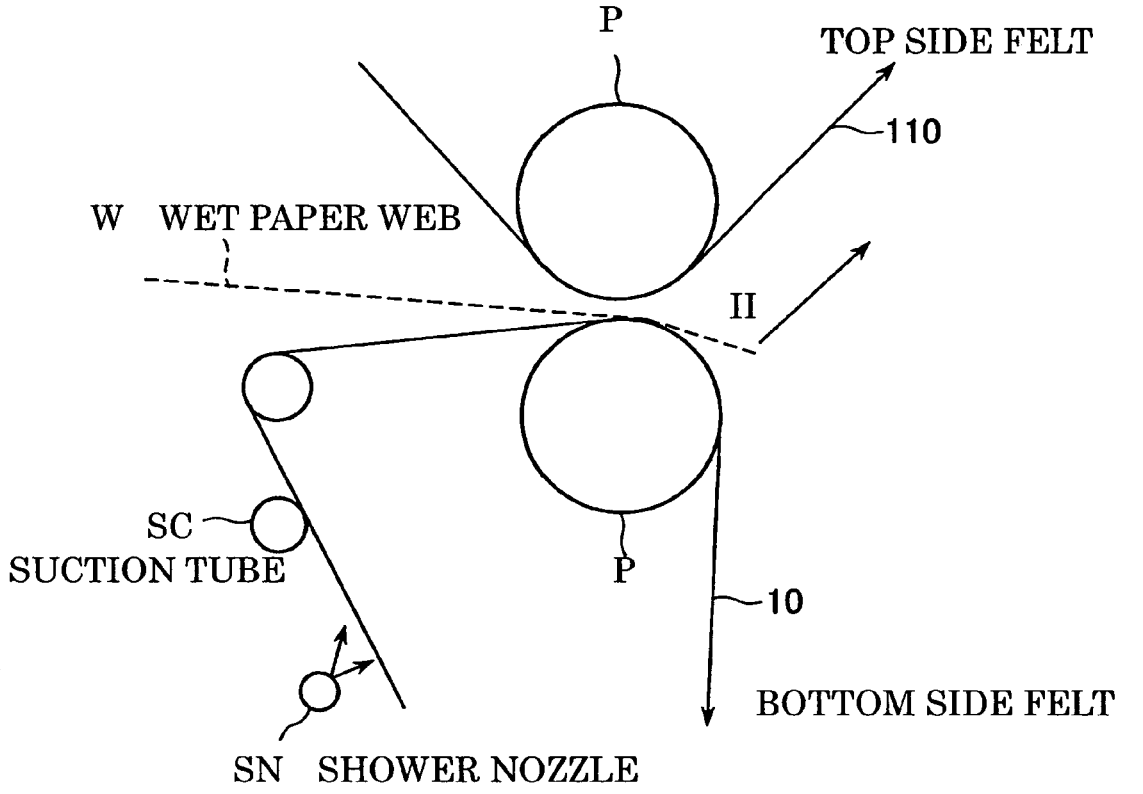
FIG. 11 is an explanatory view of another apparatus for determining the effects of a press felt according to the invention.
Figure 13:
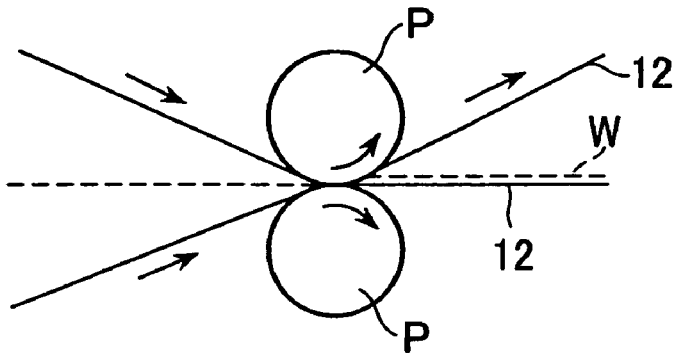
FIG. 13 PRIOR ART
FIG. 13 is a schematic view of the press part of a papermaking machine.
Figure 14:
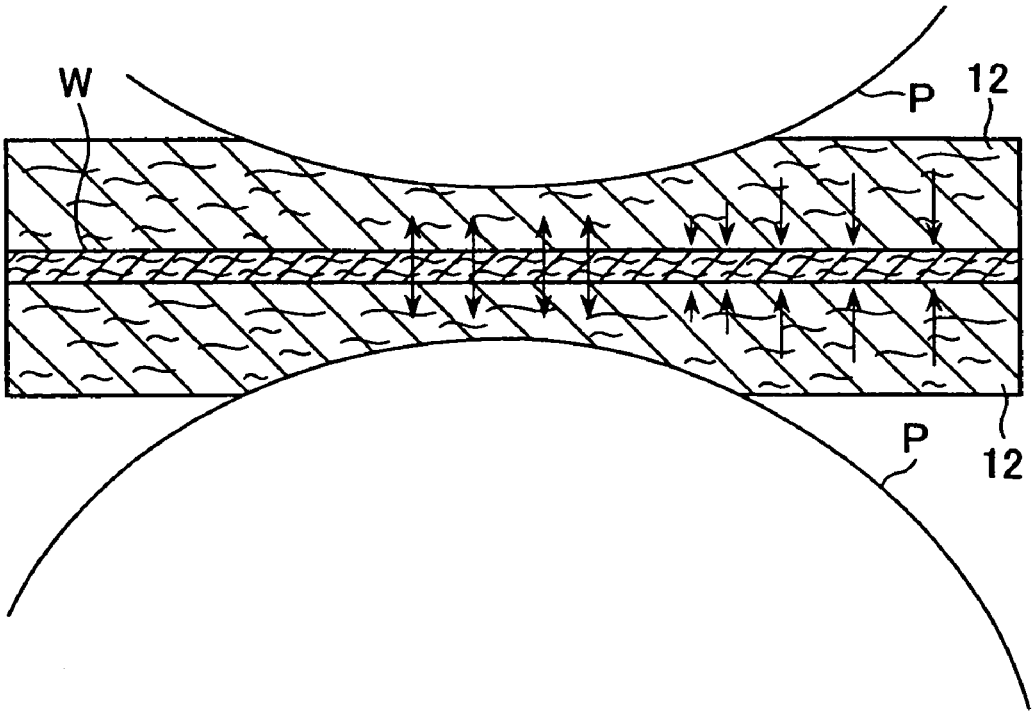
FIG. 14 PRIOR ART
FIG. 14 is an enlarged view of the press nip, illustrating the transfer of water out of, and back into, a wet paper web.
Figure 15:
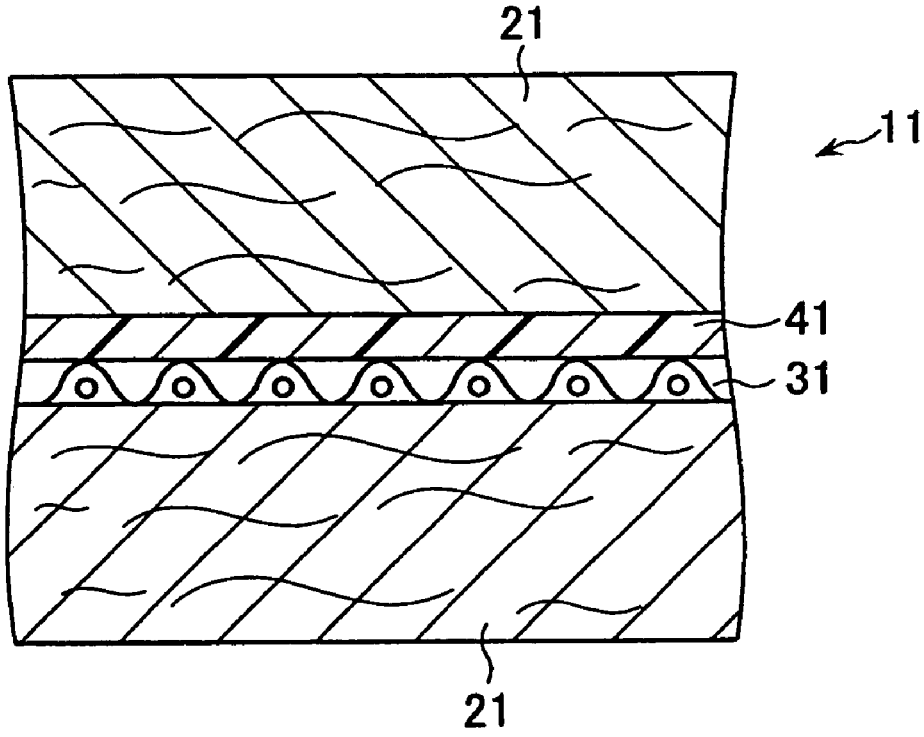
FIG. 15 PRIOR ART
FIG. 15 is a cross-sectional view of a conventional press felt.

The apparatuses shown in FIGS. 10 and 11 both had a felt travel speed of 500 m/min, and a press pressure of 100 kg/cm$^2$.

In the apparatus shown in FIG. 10, as the wet paper web moves out of the nip, it is transferred on the bottom side felt 10. The water content of the wet paper web, in which re-wetting occurs, may be obtained, by measuring water content of the wet paper web at the press exit, to which it is transferred after it moves out of the nip and on the bottom side felt 10.

The apparatus shown in FIG. 11 has a large area over which the bottom side felt 10 comes into contact with the press roll, and the time during which the wet paper web moving out of the nip is in contact with the felts 10 and 110 is very short. Here, the water content of a wet paper web in which little re-wetting occurs may be obtained, by measuring the water content of the wet paper web immediately after it moves out of the nip.

Evaluation of re-wetting was conducted by determining the difference between the water content, measured by the apparatus of FIG. 10 and the water content measured by the apparatus of FIG. 11. It was assumed in the evaluation that re-wetting did not occur when the difference between the two water content measurements was less than 0.5%, and that re-wetting occurred when the difference was 0.5% or more.

As shown by the results of the experiments, as summarized in FIG. 12, the papermaking press felts according to the invention suppressed re-wetting effectively, and otherwise exhibited excellent performance, despite their relatively simple structure.

What is claimed is:

1. A press felt for papermaking, having a wet paper web contacting surface and a roll contacting surface, said felt comprising a batt, a base body, and an anti-rewetting layer, the base body and the anti-rewetting layer both being disposed within the batt and spaced from the wet paper web contacting surface, and the anti-rewetting layer comprising a non-oriented film having openings, said openings having a three-dimensional structure, each opening having a wet paper web side end and a roll side end, each of said ends having an aperture, and the aperture of the wet paper web side end of each said opening being larger than the aperture of the roll side end thereof.

2. A press felt for papermaking as claimed in claim 1, wherein each said opening is funnel-shaped and has a tubular portion.

3. A press felt for papermaking as claimed in claim 1 wherein said non-oriented film is composed of nylon, and has an elongation at break of at least 300%.

4. A press felt for papermaking as claimed in claim 2 wherein said non-oriented film is composed of nylon, and has an elongation at break of at least 300%.

5. A press felt for papermaking as claimed in claim 1, in which said film further has flat openings in addition to said openings having a three-dimensional structure.

6. A press felt for papermaking as claimed in claim 2, in which said film further has flat openings in addition to said openings having a three-dimensional structure.

7. A press felt for papermaking as claimed in claim 3, in which said film further has flat openings in addition to said openings having a three-dimensional structure.

8. A press felt for papermaking as claimed in claim 4, in which said film further has flat openings in addition to said openings having a three-dimensional structure.

* * * * *